US010383501B2

(12) United States Patent
Brown

(10) Patent No.: US 10,383,501 B2
(45) Date of Patent: Aug. 20, 2019

(54) BROOM APPARATUS WITH REMOVABLE AUXILIARY TOOL

(71) Applicant: Browns Brushware Limited, Auckland (NZ)

(72) Inventor: Murray Charles Brown, Hamilton (NZ)

(73) Assignee: Browns Brushware Limited, Auckland (NZ)

( * ) Notice: Subject to any disclaimer, the term of this patent is extended or adjusted under 35 U.S.C. 154(b) by 753 days.

(21) Appl. No.: 14/785,485

(22) PCT Filed: Apr. 17, 2014

(86) PCT No.: PCT/NZ2014/000069
§ 371 (c)(1),
(2) Date: Oct. 19, 2015

(87) PCT Pub. No.: WO2014/171843
PCT Pub. Date: Oct. 23, 2014

(65) Prior Publication Data

US 2016/0088994 A1 Mar. 31, 2016

Related U.S. Application Data

(60) Provisional application No. 61/813,949, filed on Apr. 19, 2013.

(51) Int. Cl.
*A46B 15/00* (2006.01)
*A46B 9/02* (2006.01)
(Continued)

(52) U.S. Cl.
CPC ..... *A47L 13/12* (2013.01); *A46B 3/005* (2013.01); *A46B 5/0095* (2013.01); *A46B 7/042* (2013.01);
(Continued)

(58) Field of Classification Search
CPC ..... A01B 1/20; A46B 15/0055; A46B 17/08; A46B 15/0059; A46B 15/0081;
(Continued)

(56) References Cited

U.S. PATENT DOCUMENTS 647,225 A * 4/1900 Graham ..... A46B 15/0055 15/111
774,689 A * 11/1904 McDermott ..... A46B 15/0055 15/111
(Continued)

FOREIGN PATENT DOCUMENTS

CA 2151578 A1 * 12/1996 ..... A01B 1/02
CA 2803071 A1 * 12/2011 ..... A46B 5/02
(Continued)

*Primary Examiner* — Joseph J Hail
*Assistant Examiner* — Arman Milanian
(74) *Attorney, Agent, or Firm* — Gable & Gotwals

(57) ABSTRACT

This invention relates to a broom including an elongate handle attached at one end to a head, a plurality of bristles attached to the head on a different side from the handle, and an auxiliary tool portion configured for use in any one or more of the group selected from scraping, cutting and scooping. The auxiliary tool portion is removably attached to the head and/or handle by means of a quick-release mechanism. The quick release mechanism may include a lever, skewer and stop, and the lever having a cam. The auxiliary tool portion may project forwardly from the broom and/or downwardly having a substantially rigid lower edge.

9 Claims, 5 Drawing Sheets

(51) Int. Cl.

| | |
|---|---|
| ***A47L 13/12*** | (2006.01) |
| ***B25G 3/00*** | (2006.01) |
| ***A46B 5/00*** | (2006.01) |
| ***A46B 3/00*** | (2006.01) |
| ***A46B 7/04*** | (2006.01) |
| ***A46B 9/04*** | (2006.01) |

(52) U.S. Cl.
CPC ..... *A46B 9/02* (2013.01); *A46B 9/04* (2013.01); *A46B 15/0055* (2013.01); *A46B 15/0059* (2013.01); *A46B 15/0065* (2013.01); *A46B 15/0081* (2013.01); *B25G 3/00* (2013.01); *A46B 2200/302* (2013.01)

(58) Field of Classification Search
CPC ..... A46B 15/0065; A46B 2200/302; A46B 3/005; A46B 5/00; A46B 5/0095; A46B 5/02; A46B 7/042; A46B 9/02; A46B 9/04; A47L 13/12; B25G 3/00; E01H 5/02
USPC ..... 15/111, 114, 117, 236.01, 246; D4/118
See application file for complete search history.

(56) References Cited

U.S. PATENT DOCUMENTS 913,304 A * 2/1909 Petersen ..... A46B 3/08 15/111
1,143,752 A * 6/1915 Crisman ..... A46B 15/0055 15/111
1,591,565 A * 7/1926 Schaffert ..... A46B 5/02 15/117
1,922,998 A * 8/1933 Williams ..... A47L 13/52 15/111
2,042,706 A * 6/1936 Dry ..... A47L 13/12 15/111
2,090,412 A * 8/1937 Geiger ..... B25G 1/06 15/111
2,126,023 A * 8/1938 McGoldrick ..... A46B 17/08 15/105
2,163,979 A * 6/1939 Judson ..... A47L 13/12 15/111
2,290,178 A * 7/1942 Hayford ..... A46B 5/0095 15/111
2,335,503 A * 11/1943 Gasper ..... B25G 3/12 15/117
2,687,542 A * 8/1954 Turausky ..... A47L 13/12 15/111
2,741,788 A * 4/1956 Shey ..... A47L 13/12 15/105
2,832,980 A * 5/1958 O'Neill ..... A47L 13/22 15/105
2,867,827 A * 1/1959 Gantz ..... E01H 1/12 15/111
3,084,369 A * 4/1963 Hawkins ..... A46B 17/08 15/111
3,094,728 A * 6/1963 White ..... A46B 17/08 15/111
3,097,384 A * 7/1963 White ..... A47L 13/12 15/111
3,307,212 A * 3/1967 MacInnes ..... A47L 13/12 15/111
3,487,491 A * 1/1970 Dunn ..... A47J 37/06 15/111
3,995,345 A * 12/1976 Larsson ..... A47L 13/12 15/105
4,153,287 A * 5/1979 Towsend ..... E01H 5/02 15/111
4,357,043 A * 11/1982 Towsend ..... A01B 1/20 15/111
4,597,204 A * 7/1986 Heiden ..... E01H 5/02 15/144.1
5,123,138 A * 6/1992 Flamm ..... A47L 13/12 15/111
5,161,772 A * 11/1992 DiResta ..... A46B 15/00 15/111
D355,075 S * 2/1995 Stone ..... D30/162
5,425,153 A 6/1995 Vosbikian
5,502,857 A * 4/1996 Jubinville ..... A47L 13/12 15/111
5,502,862 A * 4/1996 Vosbikian ..... A46B 5/0095 15/145
5,673,925 A * 10/1997 Stewart ..... B62K 25/02 280/279
D388,571 S * 12/1997 Campbell ..... D32/42
6,178,581 B1 * 1/2001 Lewis ..... A47L 13/12 15/116.2
6,606,756 B2 * 8/2003 Fernandez ..... A46B 9/10 15/106
6,944,980 B1 * 9/2005 Lefrancois ..... E01H 5/02 37/285
7,155,770 B2 1/2007 Anderson et al.
D553,921 S * 10/2007 Melady ..... D8/10
7,347,468 B1 3/2008 Tidcomb
7,636,979 B1 * 12/2009 Morad ..... A47L 13/146 15/116.2
D617,158 S * 6/2010 Smith ..... D8/10
8,119,201 B2 * 2/2012 Present ..... B44D 3/00 15/236.01
8,196,249 B1 * 6/2012 Spooner ..... A46B 17/08 15/117
2007/0000080 A1 * 1/2007 Libman ..... A46B 7/04 15/145
2011/0061188 A1 * 3/2011 Monteith ..... A46B 3/00 15/145

FOREIGN PATENT DOCUMENTS

GB 262347 12/1926
GB 262347 A * 12/1926 ..... A46B 5/00
GB 1170650 11/1969
GB 1170650 A * 11/1969 ..... A47L 13/29

* cited by examiner

BROOM APPARATUS WITH REMOVABLE AUXILIARY TOOL

CROSS-REFERENCE TO RELATED APPLICATIONS

This application is the United States National Phase of Patent Application No. PCT/NZ2014/000069 filed 17 Apr. 2014, which claims priority to U.S. Provisional Patent Application No. 61/813,949 filed 19 Apr. 2013, each of which is incorporated herein by reference.

FIELD OF INVENTION

The invention relates to a broom apparatus and particularly a broom apparatus with a plurality of functions. More particularly, the invention relates to a broom apparatus with the ability to receive one or more removable attachments or auxiliary tools that may each add functionality to the broom apparatus.

BACKGROUND TO THE INVENTION

Brooms are commonly used to sweep, collect, clear and otherwise clean or move material on surfaces such as floors, walls and the like. They are often used in conjunction with other equipment such as scraping devices, brushes, shovels, and the like. Many broom users therefore also use separate pieces of equipment to perform other operations during a cleaning process.

One common example of a cleaning process involving the use of multiple devices involves the use of a broom to move large amounts of material distributed across a surface into a pile, then the pile is removed from the surface using a shovel. A further example involves the use of a shovel or other instrument with a hard thin edge to remove material stuck to the surface by a scraping action, or to remove material from cracks or grooves in the surface, then the use of a broom to sweep or collect the material removed from the surface into a pile, and then the use of a shovel to remove the pile from the surface. A further example is found in maintaining the edge between a grass lawn and a paved or concrete surface. Often one implement cuts the grass where it spills over onto the paved or concrete surface, another sweeps the cut grass into a pile, and still another shovels the pile of grass elsewhere.

While it is possible to use a different implement for each of the multiple operations in such cleaning processes, there are various disadvantages associated with doing so. A user must own and maintain multiple implements, each of which take up separate space while stored or transported, and each of which comes at its own cost. Furthermore, if a user is cleaning a large area, it may be difficult, impractical and inefficient to carry or move multiple implements.

In many scenarios where other functions along with sweeping, for example scraping, cutting and shoveling, among other operations, are all desirable in a cleaning process, it may be cheaper, quicker, easier and generally more efficient for only one implement to be used.

There are brooms currently available that include a non-removable attachment which can be used for scraping or shoveling, but these brooms can be limited in their functionality, as the fixed nature of the attachment means that if it breaks, the broom can no longer be used for an additional purpose. These brooms with fixed attachments do not provide a user with the ability to remove the attachment, which would be useful for increasing manoeuvrability, as well as making storage easier. A further issue is that the nature of a fixed attachment means that the broom is only given the extra functionality associated with that one particular fixed attachment, even though the user may want to perform different operations with the broom on different occasions.

Many existing brooms with blades are designed so that the broom and the blade are unitary, and in some cases made of plastic material. In these existing devices, the fixed connection between broom and blade is often weak and prone to failure. When comprised of a plastics material, regardless of the connection mechanism, the blade is often not suitable for cutting and scooping, and especially not suitable for scraping rough or uneven surfaces due to its lack of strength. Existing plastic blade edges also can be easily blunted or cracked after use on rough surfaces.

Metal blades found on existing brooms often have straight edges and sharp corners. Such a blade can be unsuitable for rough and uneven surfaces as either the entire length of the blade edge must be in contact with the work surface, or just the corner.

Finally, many existing brooms that include a blade are not adapted to also be used to shovel or otherwise transport the accumulated debris or swept material.

Furthermore, many blades will accumulate material on the underside of the blade during use, and are not adapted to easily clear this material.

OBJECT OF THE INVENTION

It is an object of the invention to provide a broom apparatus adapted to receive one or more auxiliary tool portions that may each add functionality to the broom apparatus.

Alternatively, it is an object of the invention to provide an improved broom apparatus which addresses some or all of the above problems.

Alternatively, it is an object of the invention to provide an auxiliary tool for an improved broom apparatus which addresses some or all of the above problems.

Alternatively, it is an object of the invention to at least provide the public with a useful choice.

SUMMARY OF THE INVENTION

Various implementations of systems, methods and devices within the scope of the appended claims each have several aspects, no single one of which is solely responsible for the desirable attributes described herein. Without limiting the scope of the appended claims, some prominent features are described herein.

One aspect of the disclosure provides for a broom. The broom may comprise an elongate handle attached at one end to a head. The broom may comprise a plurality of bristles attached to the head on a different side from the handle. The broom may comprise an auxiliary tool portion configured for use in any one or more of the group selected from: scraping, cutting and scooping. The auxiliary tool portion may be removably attached to the head and/or handle by means of a quick-release mechanism.

A further aspect of the disclosure provides for a broom. The broom may comprise an elongate handle attached at one end to a head. The broom may comprise a plurality of bristles attached to the head on a different side from the handle. The broom may comprise an auxiliary tool member attached to the head and/or handle and comprising a projecting portion extending forwards of the bristles and a plate portion extending downwardly adjacent to the bristles. The projecting portion and the plate portion may be joined by a curved portion.

A further aspect of the disclosure provides for an auxiliary tool for a broom, wherein the broom may comprise an elongate handle attached at one end to a head and a plurality of bristles attached to the head on a different side from the handle. The auxiliary tool may comprise a projecting portion and a plate portion connected by a curved portion. The auxiliary tool may be adapted to be removably attached to the broom by a quick-release mechanism such that the projecting portion extends forwards of the bristles and the plate portion extends downwardly adjacent to the bristles.

BRIEF DESCRIPTION OF THE DRAWINGS

One or more embodiments of the invention will be described below by way of example only, and without intending to be limiting, with reference to the following drawings, in which.

BRIEF DESCRIPTION OF PREFERRED EMBODIMENTS OF THE INVENTION

Figure 1:
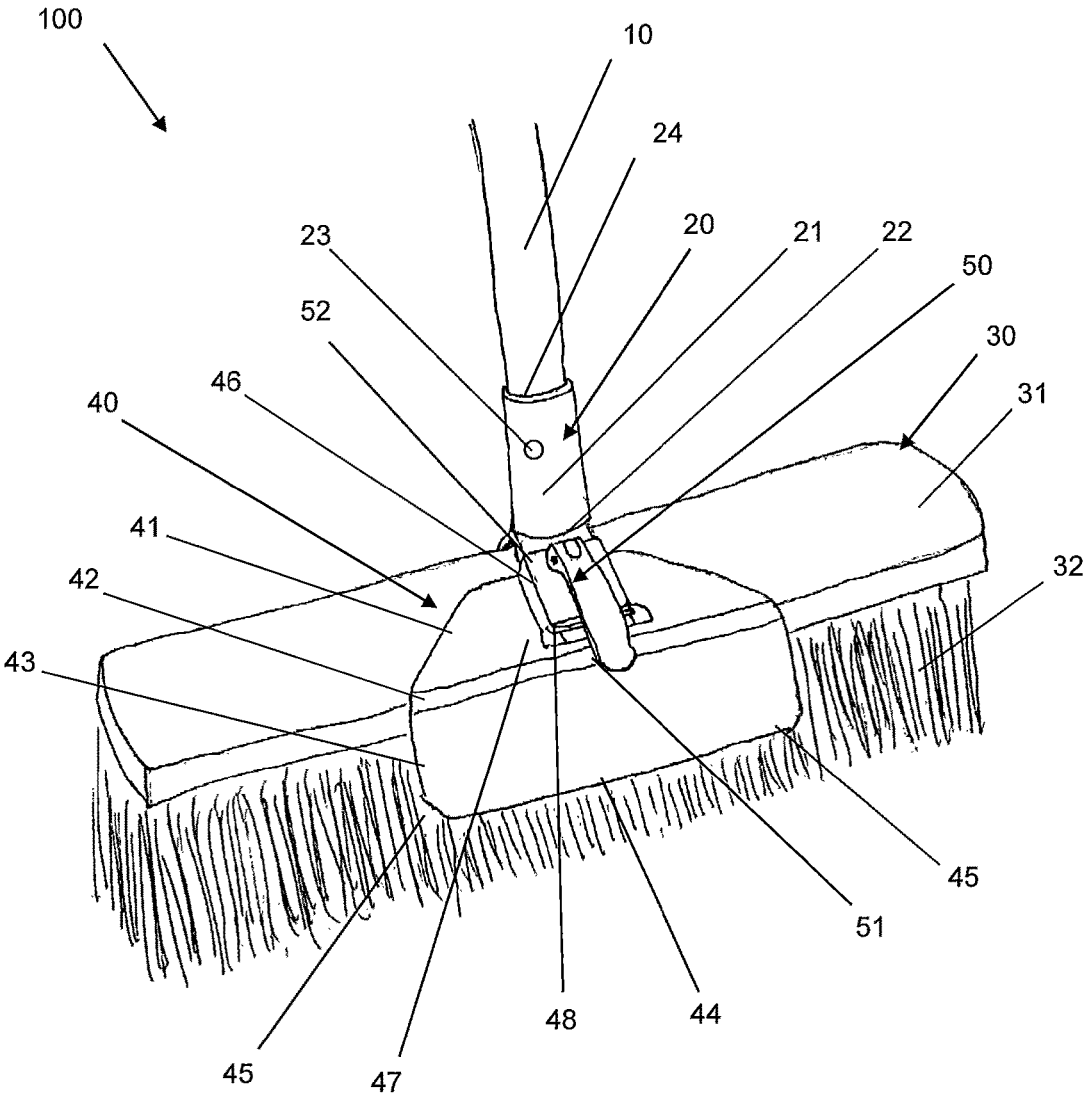
FIG. 1 is an assembly view illustration of part of a broom according to an embodiment of the invention.

FIG. 1 is an assembly view illustration of part of a broom 100 according to an embodiment of the invention. Broom 100 comprises handle 10, bracket 20, head 30, auxiliary tool portion 40, and quick-release mechanism 50.

Bracket 20 comprises a handle receiving portion 21 adapted to receive the handle 10, which may be an elongate cylindrical member. The handle 10 is received by an opening 24 within the handle receiving portion 21. Bracket 20 also comprises a through-hole 23, adapted to receive a fastener used to prevent the handle 10 from separating from the bracket 20. The handle 10 may itself comprise a hole to receive a fastener inserted through through-hole 23. Alternatively, the fastener may instead apply an inward force on the handle 10 to prevent it becoming removed from the opening 24.

The head 30 may be comprised of a rigid body portion 31 to which are attached a plurality of bristles 32. The plurality of bristles 32 are connected to and extend from the rigid body portion 31 in a direction generally away from the handle 10 or from a different side of the head to which the handle is attached.

An auxiliary tool portion 40 is connected to the head 30 by means of bracket 20 in a way that makes the tool portion easily removable. One way in which this connection may be achieved is explained below. In other embodiments of the invention, the auxiliary tool portion may be connected to the handle of the broom.

Auxiliary tool portion is a removable attachment to the broom that enables the broom to perform auxiliary functions, other than sweeping or brushing. For example, in the embodiment of FIG. 1, auxiliary tool portion 40 is configured for use in scraping, cutting and scooping material. In other embodiments an auxiliary tool portion may be provided that is operable for other uses.

Auxiliary tool portion 40 may comprise a projecting portion 41 extending forwards of the bristles. In the example shown, where the auxiliary tool portion 40 is connected to the top of the head 30, the underside of projecting portion 41 may be in contact with the upper surface of the upper body portion 31 of the head 30. A plate portion 43 may extend downwardly adjacent to the bristles. A curved portion 42 may join the projecting portion 41 and the plate portion 43. The plate portion 43 may comprise a curved lower edge 44, as well as rounded lower corners 45.

Projecting portion 41 in this embodiment comprises a substantially planar sheet. In other embodiments of the invention it may be curved, sheet-like or having varying thickness. Plate portion 43 in this embodiment is sheet-like, but comprises a curve around a vertical axis.

The curved lower edge 44 of the auxiliary tool portion 40 may be substantially narrow and rigid such that it is configured for the uses of scraping and/or cutting.

If the auxiliary tool portion 40 is used for scraping, the broom 100 may be held such that the auxiliary tool portion is adjacent to a work surface, i.e. any surface on which the broom may be used, including a floor or the ground. The curved lower edge 44 is then brought into contact with the work surface, and the broom is moved repeatedly backwards and forwards such that the curved lower edge 44 is forced between the work surface and any material which may be on or stuck to the work surface. The material is then freed from being stuck to the work surface, and either collects on the inner surface of plate portion 43, or is left on the work surface to be collected by other means, which may include being swept up using the same broom 100.

If the auxiliary tool portion 40 is used for scooping, the broom 100 may be oriented with the auxiliary tool portion generally downwards. The broom is then moved forward into the material to be scooped such that the material builds up on or in a concavity at least partially defined by the auxiliary tool portion, for example in the concavity defined between plate portion 43 and the bristles 32. In further alternative embodiments the auxiliary tool portion may comprise a concavity to help prevent collected material falling or slipping off the auxiliary tool portion. After sufficient material has been collected in or on the auxiliary tool portion, the broom may be raised upwards and/or otherwise moved in order to carry the collected material. In order to remove the collected material from the broom, the broom may be rotated such that the collected material falls from the broom due to gravity, or the broom may be shaken to dislodge collected material.

If the auxiliary tool portion 40 is used for cutting, the broom 100 may be oriented such that plate portion 43 is substantially perpendicular to the work surface or object which is to be cut. Broom 100 is then lowered with enough speed and/or force that the curved lower edge 44 slices into the work surface or object, cutting it. The curved lower edge 44 may be narrow or sharpened to some extent in order to increase the pressure it is able to exert on the work surface or object. The user may also roll the curved lower edge 44 through the work surface or object while cutting for added pressure and stability. In some cases the cutting action may be shearing, for example when cutting grass at the grass-pavement interface of a driveway or garden path. The plate portion 43 can be forced downward during use alongside the edge of a concrete or paved surface such that any grass spilling over onto the pavement will be sheared off between plate portion 43 and the pavement.

Along with allowing for a rolling movement while cutting, the curvature of the edge 44 helps to avoid the tool becoming stuck or obstructed by rough or uneven surfaces. The rounded lower corners 45 help to avoid the tool getting stuck or obstructed by cracks or other inconvenient features of rough or uneven surfaces.

The auxiliary tool portion 40 is connected to the rest of the broom 100 by means of bracket 20. Bracket 20 comprises a forwardly extending portion 22. The underside of the forwardly extending portion 22 receives, and is connected to, the head 30.

The upper surface of the forwardly extending portion 22 receives the auxiliary tool portion 40. Auxiliary tool portion 40 comprises a raised portion 46, the underside of which is in contact with the upper surface of the forwardly extending portion 22.

The auxiliary tool portion 40 also may comprise an aperture 47 to allow the most forward edge of the forwardly extending portion 22 to protrude past the raised portion 46, and receive lowered tab 48. Lowered tab 48 aids in location of the auxiliary tool portion 40, as well as providing rigidity to the connection between auxiliary tool portion 40 and bracket 20. Furthermore, aperture 47 is an aid in the process used to manufacture the auxiliary tool portion 40.

Auxiliary tool portion 40 is removably attached to the bracket 20 by quick-release mechanism 50. The head 30 may also be removably attached to the bracket by the same quick-release mechanism in some embodiments of the invention, while in other embodiments the quick-release mechanism only allows the auxiliary tool portion to be removed. Only one component of quick-release mechanism 50 is visible in FIG. 1, namely the lever 51. Lever 51 comprises a cam 52 located at an end adjacent the raised portion 46.

Connected to the same end of lever 51 as cam 52 may be a skewer (not shown in FIG. 1), which may pass through aligned slots or holes (not shown in FIG. 1) in the raised portion 46 of the auxiliary tool portion 40, the forwardly extending portion 22 of the bracket 20, and the rigid upper portion 31 of the head 30. Located at the opposite end of the skewer may be a stop (not shown in FIG. 1). The stop and the lever 51 of the quick-release mechanism 50 retain the auxiliary tool portion 40, bracket 20 the head 30. The stop may be removable from the skewer, so that the skewer can be removed to enable the complete disassembly of the auxiliary tool portion 40, bracket 20 and head 30.

When the lever 51 is in its closed position, the cam 52 engages the auxiliary tool portion 40, such that between the cam 52 and the stop on the other end of the skewer, the auxiliary tool portion, bracket 20 and head 40 are compressed together. The compression force generated by the quick-release mechanism is sufficient so that the auxiliary tool portion 40, head 30 and bracket 20 will retain their positions while the broom and auxiliary tool portion are in use.

The stop on quick release mechanism 50 may be a nut, pin or any other removable means of retaining components on the skewer.

In alternative embodiments of the invention, the quick-release mechanism may be any mechanism that removably secures the bracket 20, head 30 and auxiliary tool portion 40 in place. "Quick-release" may refer to any mechanism that can alternate between its unsecure and secure configurations in a relatively quick, easy manner. For example, a quick-release mechanism may avoid the need for the user to employ a lengthy repetitive motion such as unscrewing a fastener or other threaded component. A quick-release mechanism may also avoid the need for tooling to be used to release the mechanism, for example a spanner or screwdriver. The quick-release mechanism of FIG. 1 avoids the need to disassemble the broom components because the bracket 20, head 30 and auxiliary tool portion 40 can be fixed securely in place by simply lowering the lever 51. In alternative embodiments, the quick-release mechanism may both remove the force that fixes the components securely in place, as well as allow one or more of them to be removed from the assembly.

Alternative quick-release mechanisms may be other levers, clasps, clips, catches, or any other mechanism designed to toggle between secure and unsecure configurations. Many such mechanisms may also comprise a cam to generate compression between components and/or tension in the mechanism.

Figure 2:
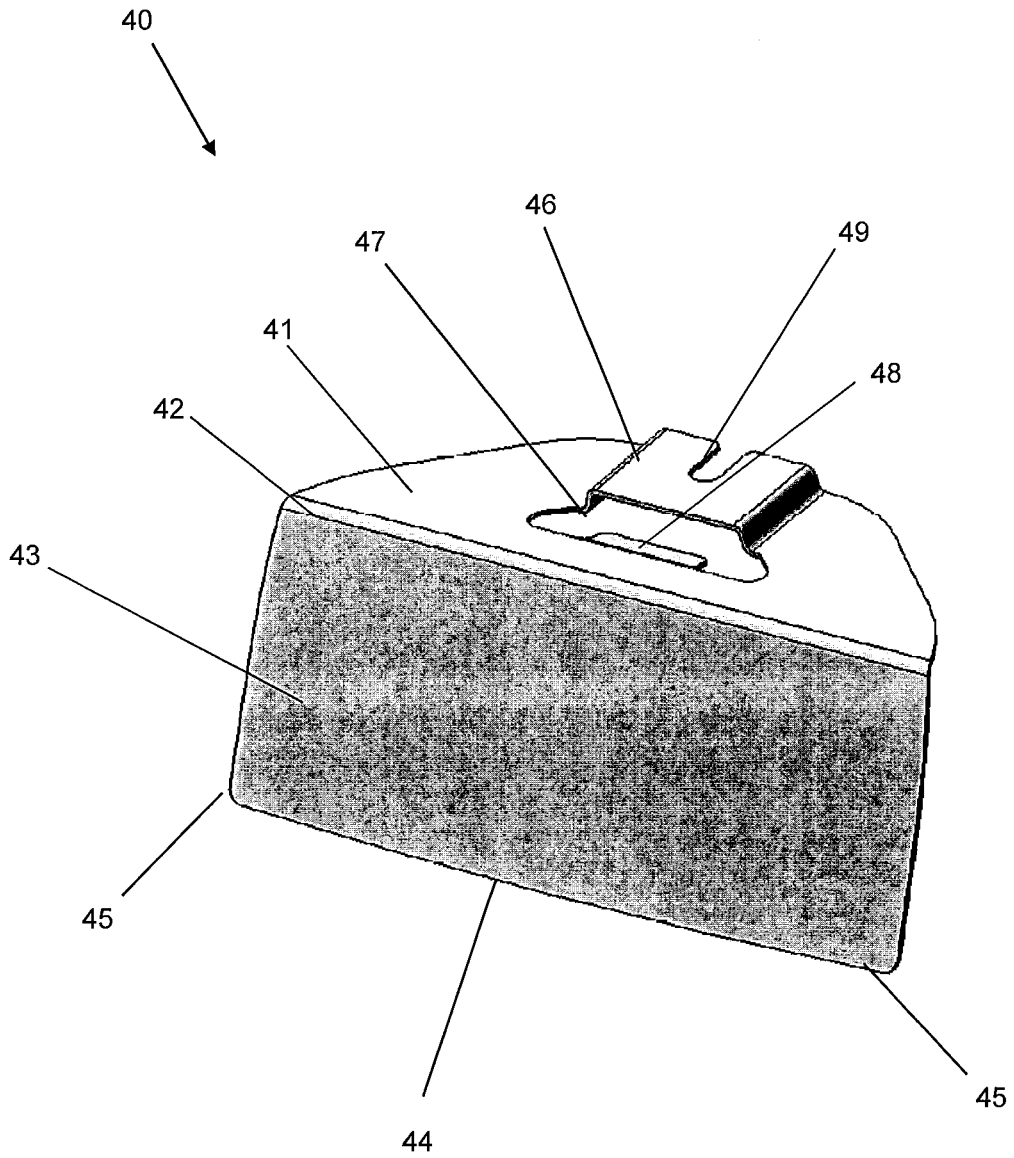
FIG. 2 is a perspective view illustration of the auxiliary tool portion shown in FIG. 1.

FIG. 2 is a perspective view illustration of the auxiliary tool portion 40 shown in FIG. 1. The auxiliary tool portion comprises a projecting portion 41, a plate portion 43, and a curved portion 42 connecting the projecting portion 41 and plate portion 43.

Plate portion 43 comprises a curved lower edge 44 which may be used for scraping or cutting purposes, as well as rounded lower corners 45, which may prevent the auxiliary tool portion 40 from catching in cracks or on uneven surfaces.

Curved portion 42 and plate portion 43 comprise a curve around a vertical axis such that when broom 100 is assembled, the side edges of auxiliary tool portion 40 are closer to bristles 32 than the centre of auxiliary tool portion 40. In alternative embodiments of the invention, the auxiliary tool portion may comprise curves about any axis. An advantage of the plate portion or other parts of the auxiliary tool portion comprising a curve is greater strength, especially in flexural stiffness. As such, the auxiliary tool portion will be more resistant to bending. Secondly, a curve aids in scooping functionality, as it is advantageous in retaining material that has been scooped up.

FIG. 2 further shows one possible shape of the raised portion 46, which is adapted to be received by the bracket 20. This view shows a slot 49, open at one end in the form of a U-shaped slot through which the skewer of quick-release mechanism 50 passes.

In use, the skewer of quick-release mechanism 50 passes through the slot 49, and the quick-release mechanism can be closed or otherwise tightened to secure, by clamping, a broom head 30, bracket 20, and auxiliary tool portion 40 together.

It is advantageous for the opening in the raised portion 46 to be in the form of an open ended slot, as it allows for the removal of auxiliary tool portion 40 from the broom assembly by only the lifting of the lever of the quick-release mechanism, and sliding the auxiliary tool portion off the skewer. There is no repetitive motion required such as the unscrewing of a nut—the lever 51 can simply be lifted and the auxiliary tool portion 40 can simply slide away from the broom.

Furthermore, slot 49 allows for a range of positions of the auxiliary tool relative to the head of the broom to be readily available to the user by adjustment of the auxiliary tool along the slot. Furthermore, different auxiliary tools could easily be swapped for one another, increasing the functionality and convenience of the broom. In some embodiments a combination of auxiliary tools may be used at once.

The shape of aperture 47 and lower tab 48 according to this embodiment of the invention are also more clearly shown in this view.

Figure 3:
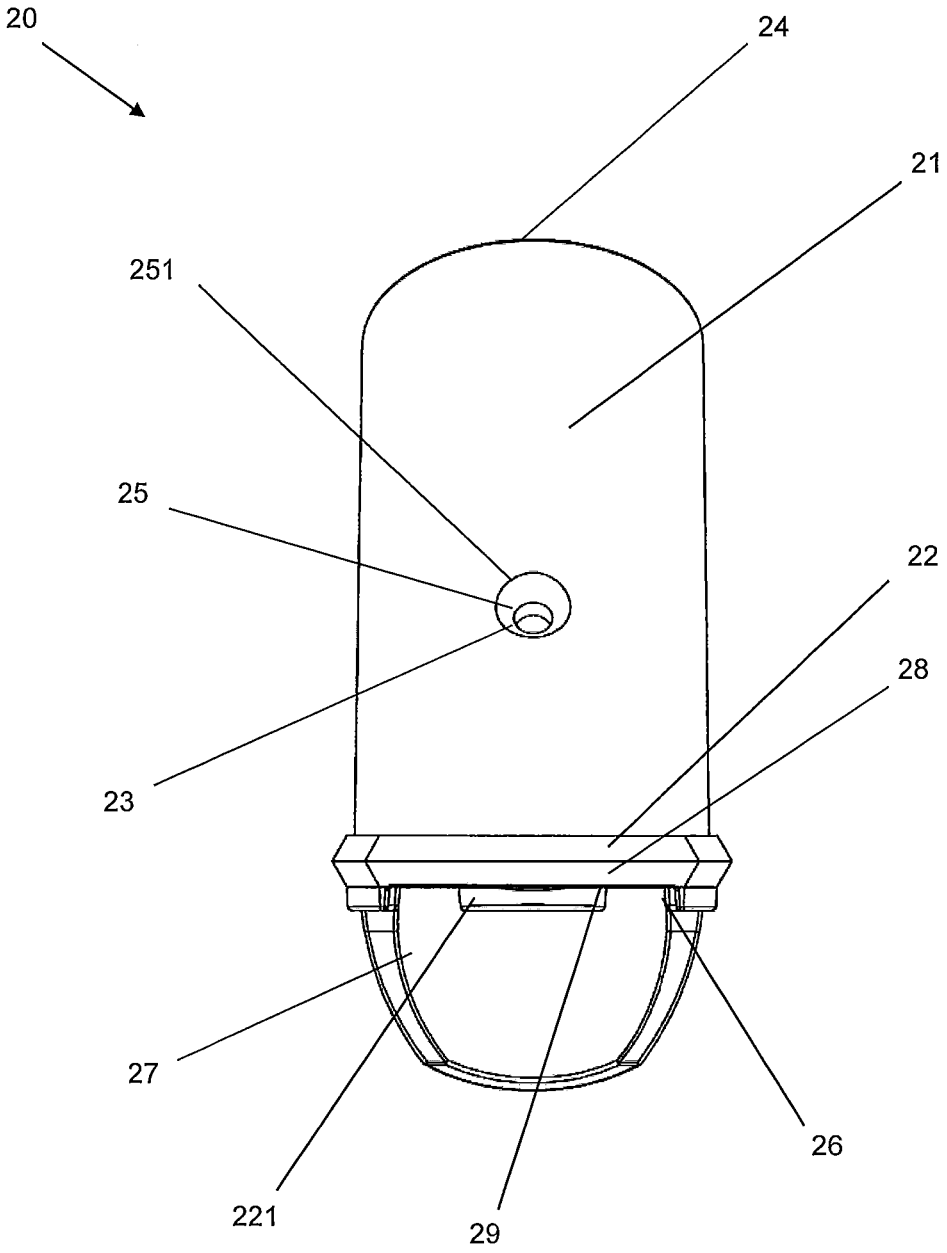
FIG. 3 is a front view illustration of the bracket shown in FIG. 1.

FIG. 3 is a front view illustration of bracket 20 of broom 100 as shown in FIG. 1, showing the already described handle receiving portion 21 and forwardly extending portion 22. Bracket 20 also comprises a backing portion 27, which is visible in this view. Backing portion 27 provides a surface for the back surface of head 30 to make contact with, and in doing so aids in location of head 30 during assembly of broom 100, as well as providing rigidity to the assembly.

Further detail of through-hole 23 is visible in this view, through which a fastening member may pass to secure the handle 10. Through-hole 23 comprises a cylindrical portion 25 and a countersunk portion 251. Cylindrical portion 25 provides accurate location of the fastening member, while countersunk portion 251 aids in the insertion of the fastening member, and allows for the use of a fastening member with a radially enlarged head such that the outermost end of surface of the head will be flush with the outermost surface handle receiving portion 21.

Visible in this view is the cutaway 26 located on the underside of the forwardly extending portion 22. Cutaway 26 is adapted to receive lowered tab 48, aiding in location and securing of the auxiliary tool portion 40. In use, the upper surface of lowered tab 48 is secured in contact with the roof 29 of cutaway 26. Also visible in this view is that forwardly extending portion 22 comprises a chamfered lower edge 28, which aids in insertion of lowered tab 48 into cutaway 26. This aids in assembly of the broom 100. Forwardly extending portion 22 also comprises a shoulder 221 which surrounds an aperture through which skewer of quick-release mechanism 50 may pass. More detail of shoulder 221 is visible in FIG. 4.

Figure 4:
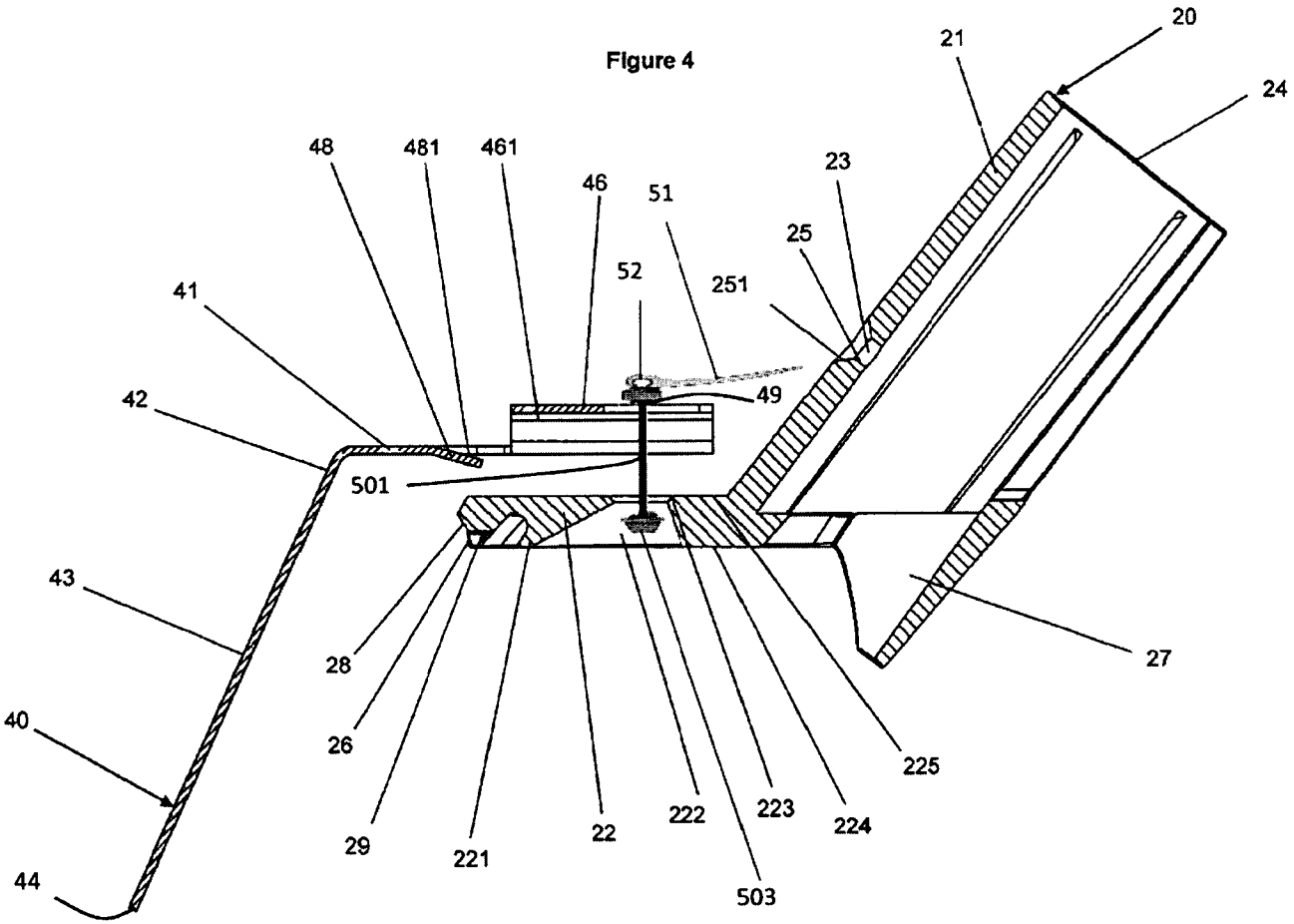
FIG. 4 is an exploded side cross section view illustration of the connection between the bracket shown in FIG. 3 and the auxiliary tool portion shown in FIG. 2 of the broom shown in FIG. 1.

FIG. 4 is an exploded side cross section view illustration of the connection between bracket 20 shown in FIG. 3 and auxiliary tool portion 40 shown in FIG. 2 of broom 100 shown in FIG. 1 according to an embodiment of the invention. Handle receiving portion 21, forwardly extending portion 22, backing portion 27, through-hole 23, cylindrical portion 25, countersunk portion 251, cutaway 26, roof 29 and chamfered lower edge 28 as already described with reference to the previous figures are again visible in this view.

Visible in this view is aperture 222 of bracket 20 through which a skewer of quick-release mechanism 50 may pass. Aperture 222 may have an angled lower edge to ease removal from the tool. Aperture 222 also comprises a chamfered upper edge 223, which helps to protect the edge of the aperture, as well as aiding in the insertion of a skewer of quick-release mechanism 50.

Further detail of shoulder 221 of aperture 222 is shown in this view. Combining the views offered by FIGS. 3 and 4, shoulder 221 can be seen to surround the lower edge of aperture 222. The lower surface of shoulder 221 is pressed against the upper surface of upper rigid portion 31 of head 30 when the broom shown in FIG. 1 is assembled.

During assembly, lower surface 461 of auxiliary tool portion 40 and upper surface 225 of bracket 20 are brought into contact with each other. Slot 49 can be aligned with aperture 222 in order for the skewer of a quick-release mechanism to pass through. Upper surface 481 of lowered tab 48 is in use brought into contact with roof 29 of cutaway 26. The skewer of a quick-release mechanism can then be inserted through the aligned openings in the bracket 20, auxiliary tool portion 40, and broom head 30. Alternatively the skewer may first be inserted through the aligned openings of the bracket 20 and the broom head 30, and then the auxiliary tool portion 40 can be inserted into the assembly with slot 49 passing around the skewer of the quick-release mechanism.

FIG. 4 illustrates that projecting portion 41 extends forwardly from bracket 20 and the other elements comprising broom 100, then curved portion 42 curves downwards, and finally plate portion 43 extends downwards, adjacent to the plurality of bristles 32 as shown in FIG. 1 but not included here. This forward and then downward extension spaces the auxiliary tool portion from the rest of the broom 100 and bristles 32, which allows for unobstructed cutting and scraping action by the auxiliary tool portion.

In some embodiments, there may be a curved portion between a projecting portion and a plate portion of the auxiliary tool portion. It may be advantageous that projecting portion 41 and plate portion 43 are connected by a curved portion. Firstly, a curved portion such as curved portion 42 reduces stress concentration in the region between projecting portion 41 and plate portion 43. Thus the use of a large radius in the form of a curved portion helps to strengthen the auxiliary tool. Secondly, a curved portion allows for material to be cleared from the auxiliary tool portion easily without getting stuck. The curved portion may be a radius of any size. In particular embodiments the curved portion may comprise a radius of 10-25 mm, for example 16.2 mm. Alternatively the radius may be smaller, for example within a range of 2-10 mm, for example 3.5 mm.

Figure 5:
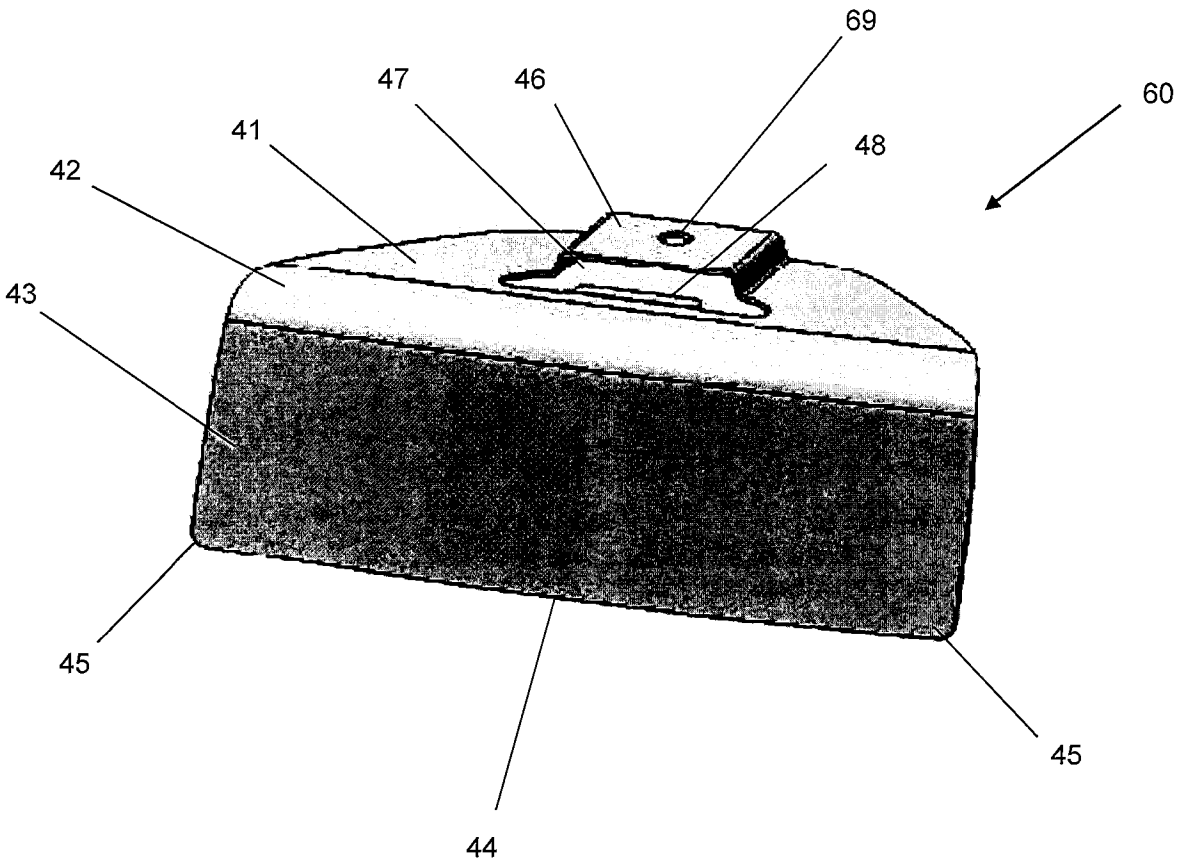
FIG. 5 is a perspective view illustration of an auxiliary tool portion for a broom according to an embodiment of the invention.

FIG. 5 shows an auxiliary tool portion 60 for a broom according to an alternative embodiment of the invention.

Auxiliary tool portion 60 comprises many of the same features as auxiliary tool portion 40, and like features are assigned like reference numerals, even though the particular relative shape and size of some like features may vary between auxiliary tool portions 40 and 60.

Auxiliary tool portion 60 comprises a hole 69 in the raised portion 46, in contrast to the slot 49 found in the raised portion 46 of auxiliary tool portion 40. The use of a hole in the auxiliary tool portion may be advantageous for when it is necessary to rotate the tool, for example to expose a new leading edge. The hole allows the auxiliary tool portion to be rotated about the axis of the skewer of a quick-release mechanism without accidently removing the auxiliary tool portion from the broom.

In the embodiments described in the figures, the component parts of the broom assembly may be formed from any appropriate material. For example, the handle 10 may made out of a plastic or wooden material, the upper portion 31 and bristles 32 of the head 30 may be made out of a plastics material. The bristles 32 may alternatively be made out of a fibrous material. The bracket 20 and auxiliary tool portion may be made out of steel, stainless steel, aluminium or plastic. Each of these materials has its own advantages, and different embodiments of the invention may be suited by different materials better than others. Steel provides excellent strength, which is very important, as the broom may be used for industrial, commercial or civil maintenance purposes. Stainless steel is particularly advantageous as it is both very strong and resistant to corrosion without the need for coating. Stainless steel may allow the broom to be used in environments that may be wet or otherwise corrosive. Aluminium is advantageous in embodiments of the invention where weight is an important factor, as it is lightweight while retaining significant strength. Plastic may be used in further embodiments where a low weight is even more important or for applications where strength is not a major necessity. In alternative embodiments, other materials may be used.

The auxiliary tool portion may comprise a sheet material of any thickness. In particular embodiments, the auxiliary tool portion has a thickness of 0.8-1.5 mm, for example 1.2 mm. The auxiliary tool portion may be formed from a single blank of material, and while it may be formed using any operation, particular embodiments may involve a first operation such as laser cutting or stamping, and a second operation such as bending or rolling, and may involve further operations. The auxiliary tool portion is therefore designed to reduce time and material costs associated with manufacturing, and can be manufactured using relatively cheap machines requiring only basic operator skill.

In alternative embodiments, an auxiliary tool portion may not first extend forward away from the broom, and may rather extend straight downwards alongside the bristles. In such embodiments the auxiliary tool portion may still define a concavity in order to be usable as a scoop. An embodiment with an auxiliary tool portion extending straight downwards alongside the bristles is advantageous in enabling scraping, cutting or scooping while reducing the size of the device, making it suitable for use in tight spaces.

In alternative embodiments there may be an oblique angle between the downwardly extending auxiliary tool portion and the bristles of the broom, while in others the auxiliary tool portion and the bristles may extend parallel to each other. An oblique angle can be advantageous in clearing material that may have collected on the auxiliary tool portion. Furthermore, an oblique angle may be advantageous in providing a scraper or cutter with clearance from the bristles of the broom, keeping the bristles out of the way during use of the broom for scraping or cutting purposes. An oblique angle also allows the auxiliary tool portion to be larger without interfering with the sweeping capability of the broom, as it extends both outwards and downwards. In particular embodiments the plate portion may extend downwards at approximately 55°-70° to the projecting portion, for example 65°.

In a further alternative embodiment the auxiliary tool portion may extend downwards parallel to the bristles of the broom. An auxiliary tool portion extending parallel to the bristles may be advantageous in brooms designed for use in tight spaces, as it keeps the cross section of the broom small. Furthermore, the auxiliary tool in such an embodiment may be strong, as there is less leverage being applied to the auxiliary tool portion, and there is no stress concentration such as would be generated at a curved or corner transition between forward and downward portions.

In further alternative embodiments, the auxiliary tool portion may extend only in a forward direction away from the broom rather than downward. Such an embodiment is useful for a shorter scraper which may not be required to collect material in a scooping manner. It may be advantageous in providing a broom that has scraping and/or cutting functionality while reducing potential interference with the bristles, and reducing the size of the broom.

In alternative embodiments, the plate portion of the auxiliary tool portion may instead comprise a curve such that it is a section of a cylinder. While well suited to scooping, such an embodiment may be particularly useful in moving large quantities of material, such as snow or sand. Furthermore, if oriented with the concavity facing away from the bristles, this embodiment would allow the user to carry a scooped load of material while keeping the handle of the broom upright, which the user may find comfortable.

In alternative embodiments, there may be no discrete bracket connecting the handle, head, and auxiliary portion of the broom. There may instead be means for the head and auxiliary tool portion to connect to the handle. In further alternative embodiments the handle and head may be unitary, and the auxiliary tool portion may removably attach to either the head or the handle.

In some embodiments, when the quick-release mechanism is in its open, or unlocked, position, the broom head is able to be rotated 180 degrees about a vertical axis and then re-secured by the quick-release mechanism. Such an embodiment may be advantageous in some applications because the broom may be used to push or pull in one direction more than the other, resulting in the bristles wearing on one side more than the other. In this situation, the quick-release mechanism can be unlocked, the broom head can be rotated to expose the unworn bristles to the direction in which the broom is commonly used, and the quick-release mechanism locked or secured once more. This may effectively extend the usable life of the broom or broom head.

In some embodiments of the invention the bracket may be specifically designed to allow the broom head to be rotated. For example, there may be no backing portion of the bracket, or the backing portion may be short enough for the broom head to be rotated underneath it after the quick-release mechanism is opened. In some embodiments the bracket may also comprise a slot through which the skewer of a quick-release mechanism may pass, rather than a hole, in which case the bracket could be removed from the assembly in a similar fashion to the auxiliary tool portion 60, which also comprises a slot rather than a hole.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavor in any country in the world.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A broom comprising:

an elongate handle attached at one end to a head;

a bracket including a handle receiving portion and a forwardly extending portion;

a plurality of bristles attached to the head on a different side from the handle; and an auxiliary tool portion configured for use in any one or more of the group selected from: scraping, cutting and scooping, wherein the auxiliary tool portion is removably attached to the head and/or handle by means of a quick-release mechanism, the quick-release mechanism comprising:

a skewer projecting through holes in the auxiliary tool portion and the head and/or handle;

a lever comprising a cam at a first end thereof, the first end being rotatably mounted to a first end of the skewer; and a stop mounted at a second end of the skewer;

wherein the hole in the auxiliary tool portion is in the form of an open-ended slot allowing the auxiliary tool portion to be slidably removed upon release of the quick-release mechanism;

the auxiliary tool portion further including:

a projecting portion extending forwardly of the bristles, the projecting portion including an aperture containing a lowered tab relative to an upper surface of the projecting portion; and a plate portion extending downwardly adjacent to the bristles;

wherein in an assembled state, a lower surface of the forwardly extending portion of the bracket is received by the aperture of the projecting portion and resides above, and in contact with, the lowered tab.

2. A broom as claimed in claim 1, wherein the auxiliary tool portion comprises a rigid sheet portion extending forwardly and/or downwardly from the head, the rigid sheet portion having a substantially rigid lower edge.

3. A broom as claimed in claim 1, wherein the auxiliary tool portion comprises a lower cutting edge.

4. A broom as claimed in claim 1, wherein the auxiliary tool portion is configured to at least partially define a concavity within which material can be retained.

5. A broom as claimed in claim 1, wherein the auxiliary tool portion comprises at least one of a curved lower edge and rounded lower corners.

6. A broom as claimed in claim 1, wherein the auxiliary tool portion is removably attached to the handle and/or head by means of the bracket.

7. A broom as claimed in claim 1, wherein the auxiliary tool portion comprises a raised portion adapted to be received by the upper surface of the forwardly extending portion of the bracket.

8. A broom as claimed in claim 1, portion comprises the projecting portion and plate portion being joined by a curved portion, the curved portion being spaced forwardly of the head.

9. The broom as claimed in claim 1, wherein the auxiliary tool portion is formed from a metallic material.

* * * * *